US007048079B1

(12) United States Patent
Parker

(10) Patent No.: US 7,048,079 B1
(45) Date of Patent: May 23, 2006

(54) MUD SAVER VALVE

(75) Inventor: William B. Parker, Bay Springs, MS (US)

(73) Assignee: Mud Saver, Inc., Houston, TX (US)

( * ) Notice: Subject to any disclaimer, the term of this patent is extended or adjusted under 35 U.S.C. 154(b) by 312 days.

(21) Appl. No.: 10/193,629

(22) Filed: Jul. 11, 2002

(51) Int. Cl.
*E21B 21/10* (2006.01)
*F16K 51/00* (2006.01)

(52) U.S. Cl. ..... 175/218; 175/317; 166/322; 166/325; 137/327

(58) Field of Classification Search ..... 175/218, 175/317; 166/322, 325; 137/327
See application file for complete search history.

(56) References Cited

U.S. PATENT DOCUMENTS 4,364,407 A * 12/1982 Hilliard ..... 137/71
4,625,755 A * 12/1986 Reddoch ..... 137/327
4,658,905 A * 4/1987 Burge ..... 166/373
4,962,819 A * 10/1990 Bailey et al. ..... 175/218
5,425,397 A * 6/1995 Mackal ..... 137/540
5,499,745 A * 3/1996 Derian et al. ..... 222/136
5,598,974 A * 2/1997 Lewis et al. ..... 239/135
6,554,022 B1 * 4/2003 Wakeman ..... 137/505.42

* cited by examiner

*Primary Examiner*—David Bagnell
*Assistant Examiner*—Shane Bomar
(74) *Attorney, Agent, or Firm*—The Matthews Firm

(57) ABSTRACT

A three-part sub-assembly comprising a wire line retrievable spear. The spear having two fluid chambers. A diverter valve having a truncated, inverted cone valve seat is preferably threaded into the interior of the spear. A diverter valve stem, having back-to-back cones is located within the interior of the spear/diverter valve combination, with one of the cones having a linear extension which prevents the first cone from completely seating against the valve seat within the interior of the spear. The spear/diverter valve assembly and a spring-loaded piston is placed within the interior of the cylinder and utilizes an adjustable ring within the interior of the cylinder as an adjustment for varying mud weights.

3 Claims, 7 Drawing Sheets

MUD SAVER VALVE

BACKGROUND OF THE INVENTION (A) Field of the Invention

This invention relates to apparatus for preventing the loss of drilling mud when the kelly is disconnected from the drill pipe.

(B) Description of the Prior Art

In the drilling of oil and gas wells, it is common practice to insert in the drilling string between the kelly and the drill pipe a valve to retain mud in the kelly when the drill string is broken. The advantages of using such a valve are well known and include saved mud cost, decreased chances of pollution, and increased safety to rig personnel.

Typical valves of the mud retaining type are illustrated in the following patents:

| Patentee | U.S. Pat. No. |
|---|---|
| Taylor | 3,331,385 |
| Garrett | 3,698,411 |
| Litchfield, et al | 3,738,436 |
| Williamson | 3,965,980 |
| Liljestrand | 3,967,679 |

All of the above listed patents include a downwardly opening spring loaded poppet type valve enclosed in a body having at least two parts. These two extra pieces in the drill string replace a single piece kelly saver sub, which functions to reduce wear on the kelly pin. The two-part body is generally longer than a standard kelly saver sub and consequently increases the length of the string which must be handled at the rig. In most offshore operating areas, it is mandatory that a lower manually operated kelly safety valve be included in the string at all times, which is another addition to the length of the string which must be handled. Thus, on offshore rigs, where the height of the derrick or mast is usually limited, it may be impossible to include mud retaining type valve with a two-part body.

An additional disadvantage inherent in mud retaining valves with two-part bodies is that the pin of the lower body member replaces the pin of the kelly saver sub and is therefore subject to tremendous wear. This wear limits the longevity of the pin and therefore the longevity of the valve. A solution to this problem has been to insert an additional short sub below the lower body member. However, this solution is not entirely satisfactory because it adds still more length to the string.

It sometimes becomes necessary to run wire line tools into the drill string to perform various downhole operations. It is therefore necessary that the mud retaining valve have means by which wire line tools may be run there through. In the device of certain of the prior art, these means take the form of a threaded plug screwed into the central portion of the movable poppet. To remove the plug of the apparatus, a tool is run into the string to engage a bolt headed portion of the plug and rotated to thereby unscrew the plug. In the valves of the other above cited patents, the central portion of the movable poppet includes a cap of a frangible material that may be broken out with a sinker bar.

Neither of these valves is entirely satisfactory. The "threaded plug" device requires a special tool for engaging and unscrewing the plug. The frangible cap of the other patents is not entirely satisfactory in that occasionally portions of the cap remain unbroken leaving jagged projections which may damage or sever the wire line. Also, the broken out portions of the cap form debris which impedes drilling. A further disadvantage of heretofore existing mud retaining valves is in the fact that none of them include means for adjusting the force with which their respective closure members are driven upwardly. The force may be insufficient to close the valve when heavy muds are used. When lighter muds are used, the force may be so excessive as to strain the mud pumps.

U.S. Pat. No. 4,128,108 to Bill Parker, et. al. is yet another example of a mud saver valve, and shows in its FIGS. 2 and 3 a mud saver valve which, when the mud pumps are on, mud can flow through the interior of the valve, but which closes when the mud pumps are turned off based upon a spring-loaded closure mechanism which does not have the spring strength to close the valve until the mud pumps are turned off. As with this mud saver valve and with the other ones above referenced, once the mud pumps are turned off, the valve closes and the mud saver valve provides its desired purpose, that of preventing the mud from being spilled out onto the rig floor when the string of drill pipe is being broken down.

DETAILED DESCRIPTION OF THE PREFERRED EMBODIMENT

Figure 1:
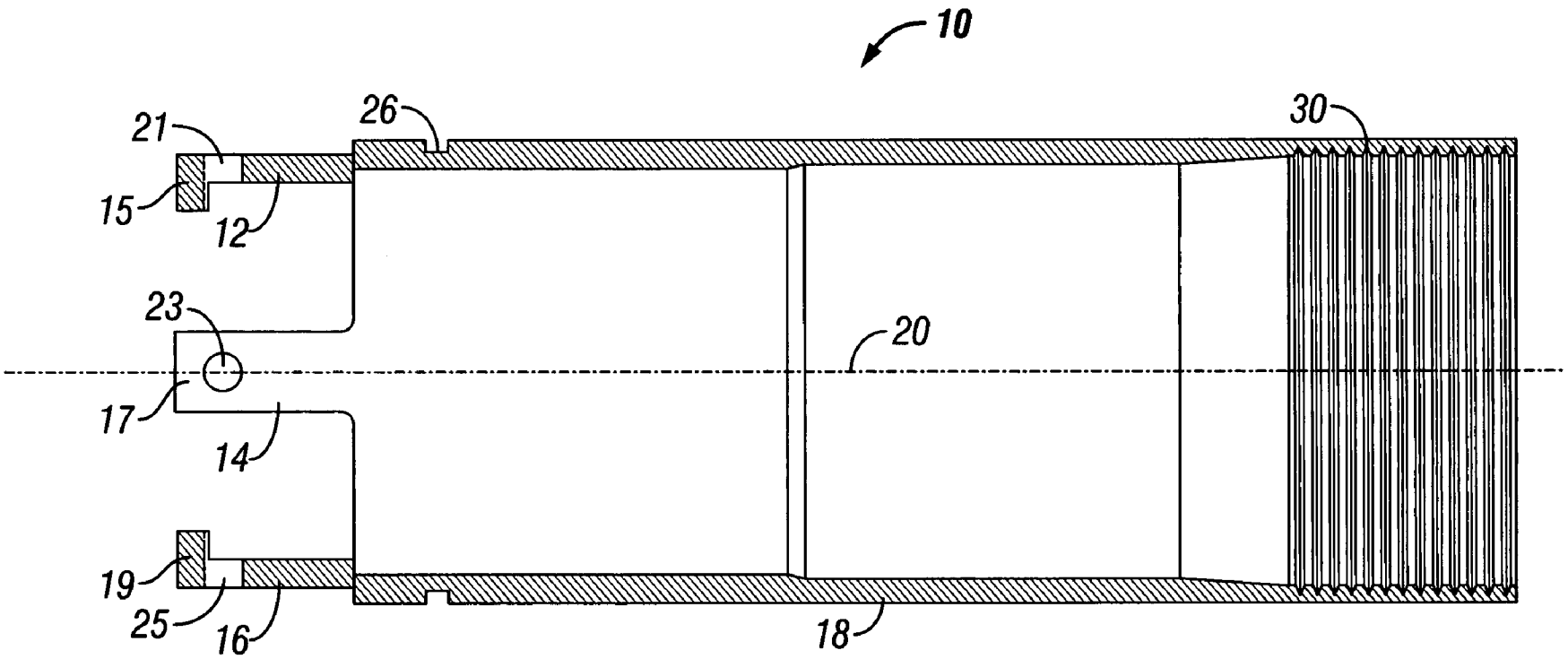
FIG. 1 is a side view of a cylinder which is used in accordance with the present invention having three extensions at one end for holding a cylinder cap in place.

Referring now specifically to FIG. 1 of the drawing, there is illustrated a cylinder 10 having a first end with three extensions 12, 14 and 16 which run parallel to the sidewall 18 of the cylinder 10. The three extensions, 12, 14 and 16, are equally spaced around the perimeter of the first end of the cylinder 10. Each of the extensions has an end portion 15, 17 and 19, respectively, which are pointed in towards the longitudinal axis 20 of the cylinder 10. Each of the extensions 15, 17 and 19 also has a throughhole 21, 23 and 25, respectively which will be used to house a set screw as will be explained hereinafter with respect to the cap illustrated in FIGS. 8A and 8B.

Near the first end of the cylinder 10, right before the beginning of the extensions 12, 14 and 16, a groove 26 goes around the side wall 18 and is sized to receive an o-ring (not illustrated). At the second end of the cylinder 10, there is an internally threaded portion 30 which is threaded to accept the external threads of the adjustment ring illustrated in FIGS. 7A and 7B.

Figure 2B:
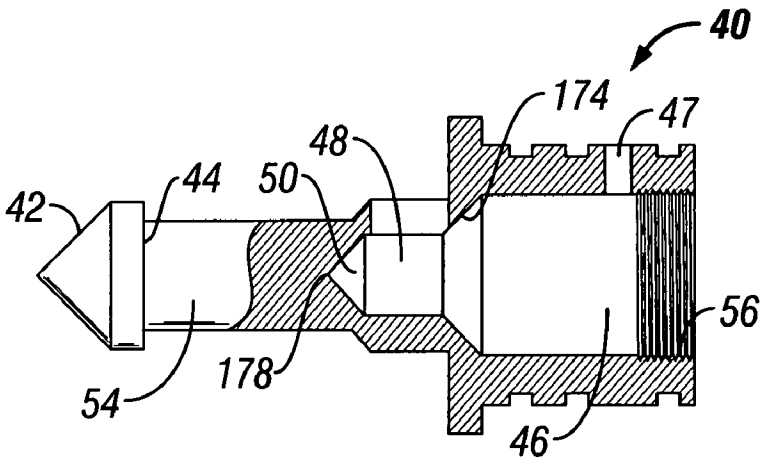
FIG. 2B is another view of the cylinder of the spear of FIG. 2 which has additional cross-sectional portions.
Figure 2A:
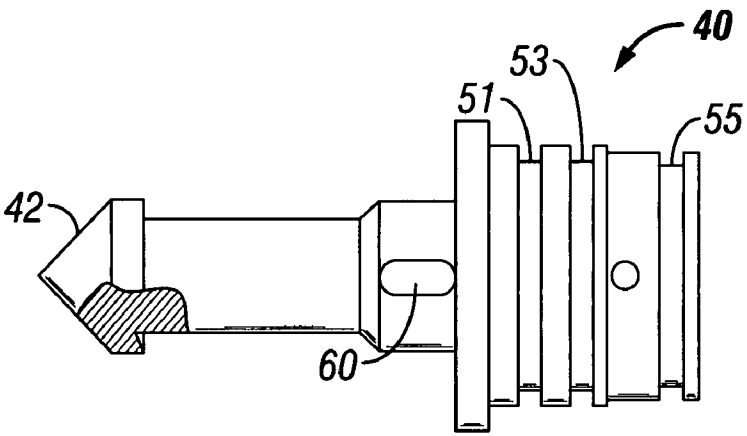
FIG. 2A is a side view of a spear, partly in cross-section, which operates within the interior of the cylinder of FIG. 1.
Figure 3B:
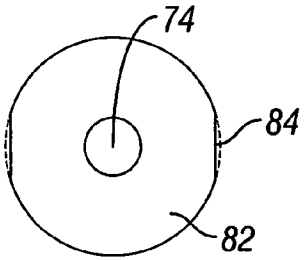
FIG. 3B is across-sectional view through the diverter valve of FIG. 3A having wrench flats for tightening the diverter valve being threaded into one end of the spear of FIGS. 2A and 2B.

Referring now to FIGS. 2A and 2B, there is illustrated a spear 40 having a first end 42 which is itself conventional and allows a wire line retrieval tool to be run into the wellbore and latch under its overhanging surface 44 to retrieve the spear 40 and the diverter valve 72 according to the present invention, should the need arise. As can best be seen in FIG. 2B, the interior of the spear 40 has a chamber 46 of a given diameter which narrows down to a chamber 48 having a tapered end 50, the purpose of which will be explained hereinafter with respect to the diverter valve stem illustrated in FIG. 4. In between the chambers 46 and 48, there is a first truncated, inverted cone valve seat having a surface 174, which although not critical, preferably has an angle of 45° from the longitudinal axis 54 of the spear 40. The spear 40 also has an internally threaded surface 56 at the second end of the spear away from the end having the wire line retrievable end 42. The diverter valve illustrated in 3A and 3B has an external thread which allows the diverter valve of FIGS. 3A and 3B to be threaded into the threads 56 of the spear 40.

The spear 40 has three peripheral slots 51, 53 and 55. Slot 51 is sized to receive three shear pins from the cap 130; slots 53 and 55 are each sized to accept a pair of o-rings, respectively.

The spear 40 also has an opening 60 which is connected into the chamber 48 illustrated in FIG. 2B and ultimately into the chamber 46 to allow fluids to pass from portions of the borehole below the mudsaver valve up through the chamber 46, the chamber 48 and out through the hole 60 up to the earth's surface to allow such fluids to be checked for pressure, mud weight, etc. The chamber 46 has a threaded orifice 47 through the side wall around the chamber 46 for receiving a set screw to prevent the diverter valve 72 from backing out of the threads 56.

Figure 3A:
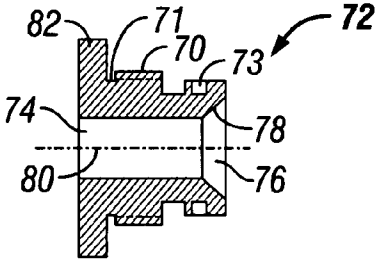
FIG. 3A is a side view, in cross-section of a diverter valve which is threaded into one end of the spear illustrated in FIGS. 2A and 2B.

Referring now to FIG. 3A, there is illustrated in cross-section the diverter valve 72 according to the present invention having external threads along the portion 70 which allows the diverter valve 72 to be threaded into the internal threads 56 of the spear illustrated in 2B. The diverter valve 72 also has a pair of peripheral grooves 71 and 73 on opposite sides of the threads 70 for receiving a pair of o-rings, respectively (not illustrated). The diverter valve 72 illustrated in FIG. 3A has an interior chamber 74 along its length but which opens up through a second truncated, inverted cone valve seat having a surface 78 to a larger volume bore 76 at one of its ends having an angled face, preferably having a 45° angle incline from the longitudinal axis 80 of the diverter valve 72 passing through the interior of the chamber 74. The diverter valve 72 has a second enlarged diameter end 82, illustrated with an end view in FIG. 3B which has two wrench flats 84 and 86 which enable the diverter valve 72 to be tightly threaded into the spear of FIGS. 2A and 2B.

Figure 4:
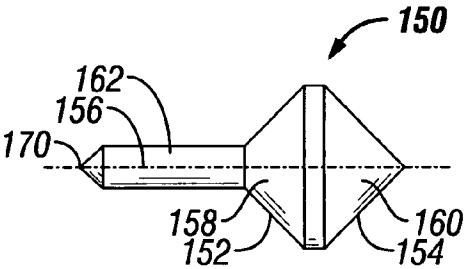
FIG. 4 is a side view of a diverter valve stem for use within the interior of the spear shown in FIGS. 2A and 2B and which moves between one end of the interior of the spear and the diverter valve depending upon whether the pressure is coming from the mud pumps being turned on at the earth's surface or whether the mud pumps are turned off.

Referring now to FIG. 4, the diverter valve stem 150 is illustrated as having a front face 152 and a rear face 154 and a longitudinal axis 156. It should be appreciated that the cone section 158 having the surface 152 and the cone section 160 having the surface 154 preferably are located back-to-back with only a small distance separating the two cones 158 and 160. The surfaces 152 and 154 are each angled at approximately 45° to the longitudinal axis 156. The valve 150 has an elongated stem 162, sometimes referred to as a "rat tail" which is sized such that when the diverter stem valve 150 is located within the chamber 46 of FIG. 2B, the tip of the stem 170 will reach the tip 178 of the cone shaped receptacle 50 and thus prevent the face 152 of the stem valve 150 from sealing with the surface 174 illustrated in FIG. 2B, simply because the rat tail 162 can not travel any further.

Figure 5:
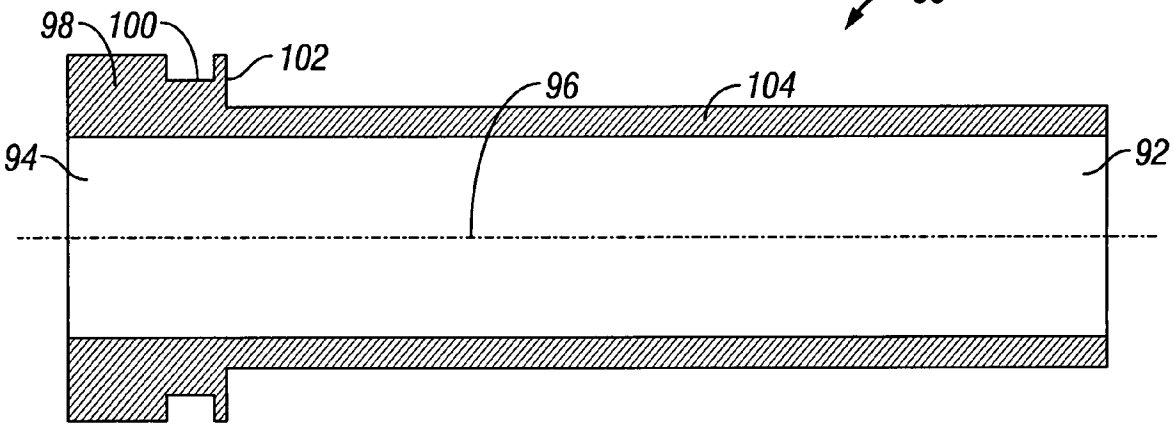
FIG. 5 is a side view, in cross section, of a piston used in the cylinder of FIG. 1.

Referring now to FIG. 5, there is illustrated a piston 90 having a first open end 92 and a second open end 94 and having a longitudinal axis 96 running along its length between the open ends 92 and 94. The end 94 has an enlarged diameter portion 98 having a groove 100 around its perimeter for receiving a seal (not illustrated). The seal which preferably is used in the groove 100 is a so-called "loaded lip" seal. The larger diameter, raised portion 98 of the piston 90 has a surface 102 around its perimeter which serves as a base against which the spring 110 illustrated in FIG. 6 can ride, wherein the spring 110 also surrounds the side wall 104 of the piston 90.

Figure 6:
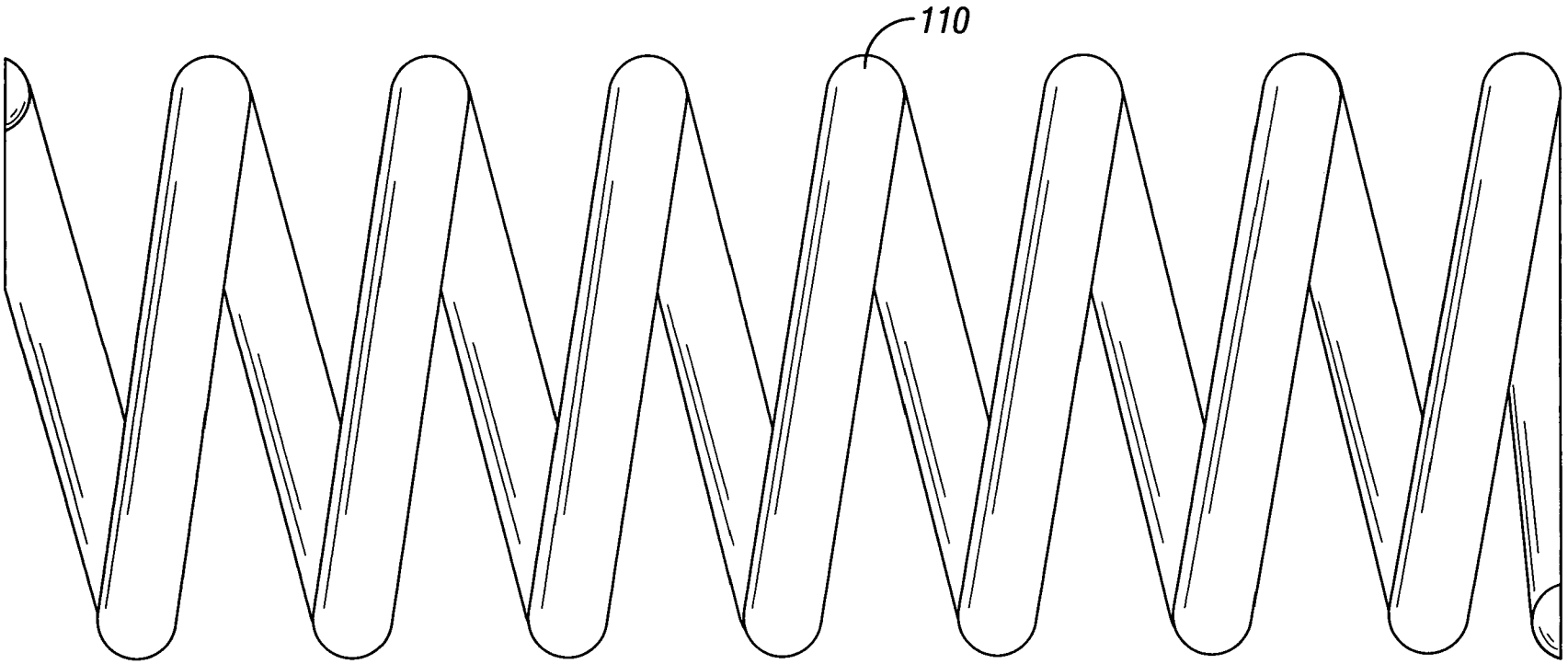
FIG. 6 is a pictorial view of a spring used with the piston of FIG. 5.

Referring now to FIG. 6, the spring 110 is illustrated. It should be appreciated that the spring 110, in use, is slipped over the side wall 104 of the piston 90 to rest against the surface 102.

Figure 7B:
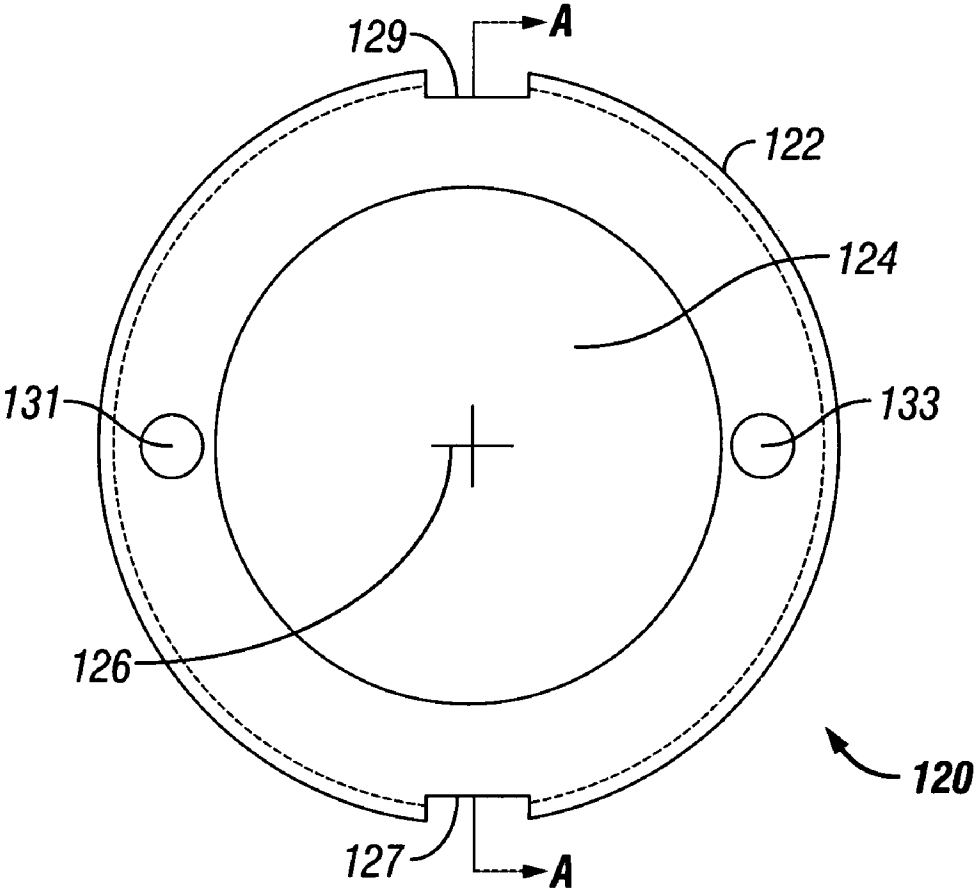
FIG. 7B is an end view of an adjustment ring having threads on its exterior which threads into a second end of the cylinder illustrated in FIG. 1 for adjusting the tension of the spring illustrated in FIG. 6.
Figure 7A:
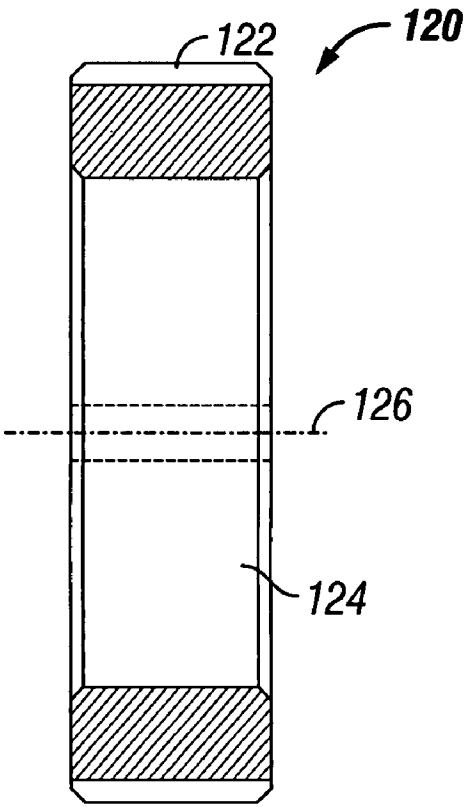
FIG. 7A is a side view taken along the section line A—A of the adjustment ring of FIG. 7B.

Referring now to FIG. 7A, there is illustrated a side view taken along the section line A—A of FIG. 7B an adjustment ring 120 which has an external thread 122 around its outer perimeter. The adjustment ring 120 has a center flow passage 124 and a longitudinal axis 126 passing along through the interior of the flow passage 124.

As illustrated in FIG. 7B, an end view of the adjustment ring 120, illustrates a pair of flats 127 and 129 into which two or more set screws can be used (not illustrated) to prevent the adjustment ring 120 from backing out of the cylinder 10. The threaded surface 122 on the exterior of the ring 120 threadedly meshes with the internal threads 30 illustrated for the cylinder 10 in FIG. 1. The adjustment ring 120 also has a pair of holes 131 and 133 for receiving a tool for turning the ring 120 into the threads 30 of cylinder 10.

Figure 8B:
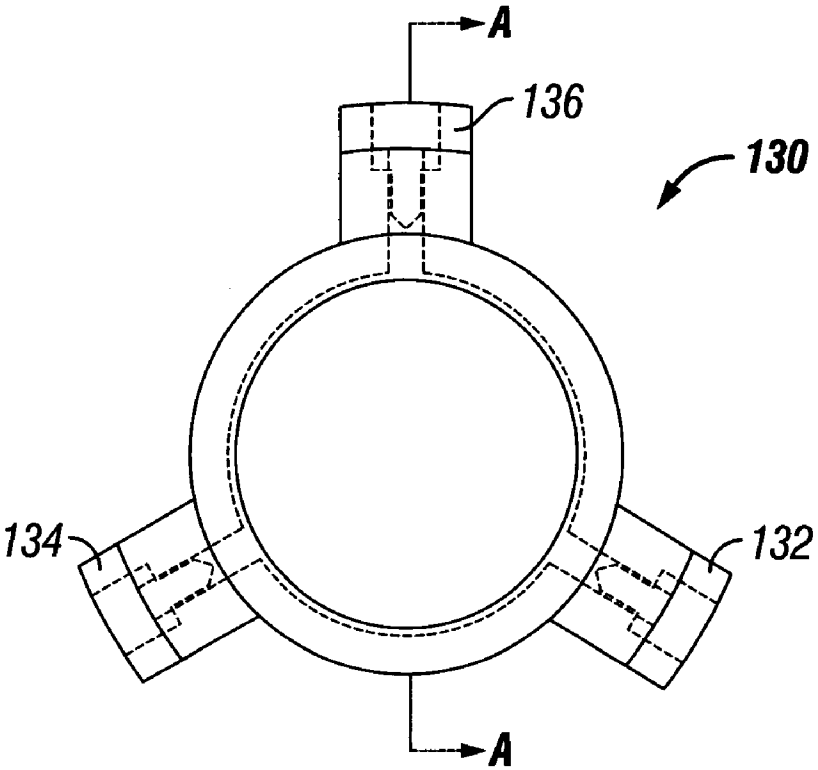
FIG. 8B is a cross-sectional view of the cap illustrated in FIG. 8A.
Figure 8A:
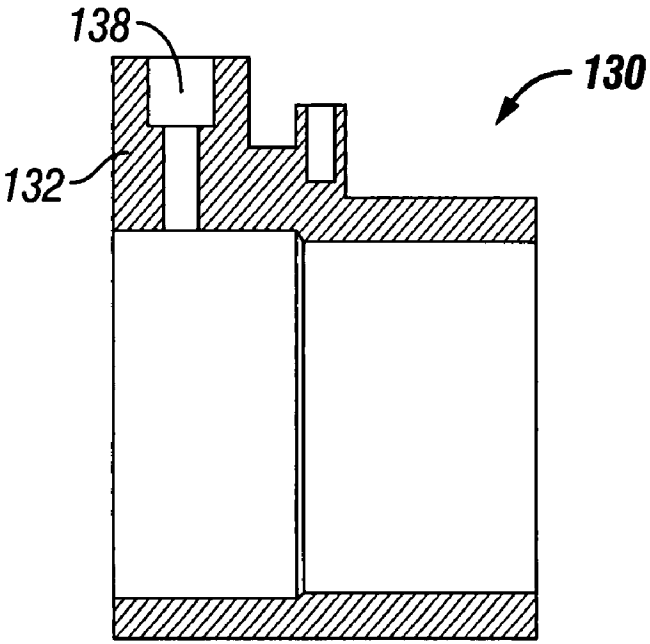
FIG. 8A is an end view of a cap designed to mate with one end of the cylinder illustrated in FIG. 1.

Referring now to FIGS. 8A and 8B, in which FIG. 8A is taken along the section lines A—A of FIG. 8B, the end cap 130 has three outwardly extended arms 132, 134 and 136 which are equally spaced around the perimeter of the cap 130. Each of the extensions 132, 134 and 136 has a groove for receiving one of the extensions 15, 17 and 19 illustrated in FIG. 1. As further illustrated in FIG. 8A, each of the extensions 132, 134 and 136 also has a hole bored through, such as the hole 138 illustrated in the extension 132 illustrated in FIG. 8A for receiving a shear pin (not illustrated).

In assembling the devices which are illustrated in FIGS. 1–8, the diverter valve stem 150 is inserted within the chamber 46 of the spear 40 illustrated in FIG. 2B, with the rat tail extension 162 pointed towards the cone shaped chamber 50 at the end of the chamber 48 in FIG. 2B. As noted previously, the rat tail portion 162 is long enough to prevent the surface 152 of the diverter valve stem 50 from sealing against the surface 174 of the spear 40. While the diverter valve stem 150 is so located within the spear 40, the diverter valve 72 is threaded into the threaded end of the spear 40 having the threads 56. With the spring 110 in place around the piston 90, the piston 90 is inserted into the cylinder 10, with the enlarged end 98 going in first, to a distance to expose at least a portion of the threads 30 of the cylinder 10 and then the adjustment ring 120 is threaded into the threaded end of the cylinder having the threads 30 of the cylinder, to thus threadedly engage the threads 122 of the adjustment ring 120. At this point, the combined spear, diverter valve and diverter valve stem can be dropped into the unthreaded end of the cylinder 10. Thereafter, the cap 130 has to be manipulated, as by a slight rotation, to have its extensions 132, 134 and 136, pass by the extensions 12, 14 and 16 of the cylinder 10. By manipulating the cap 130, the three grooves in the extensions 132, 134 and 136 mesh with the three extensions 15, 17 and 19, respectively.

Figure 9:
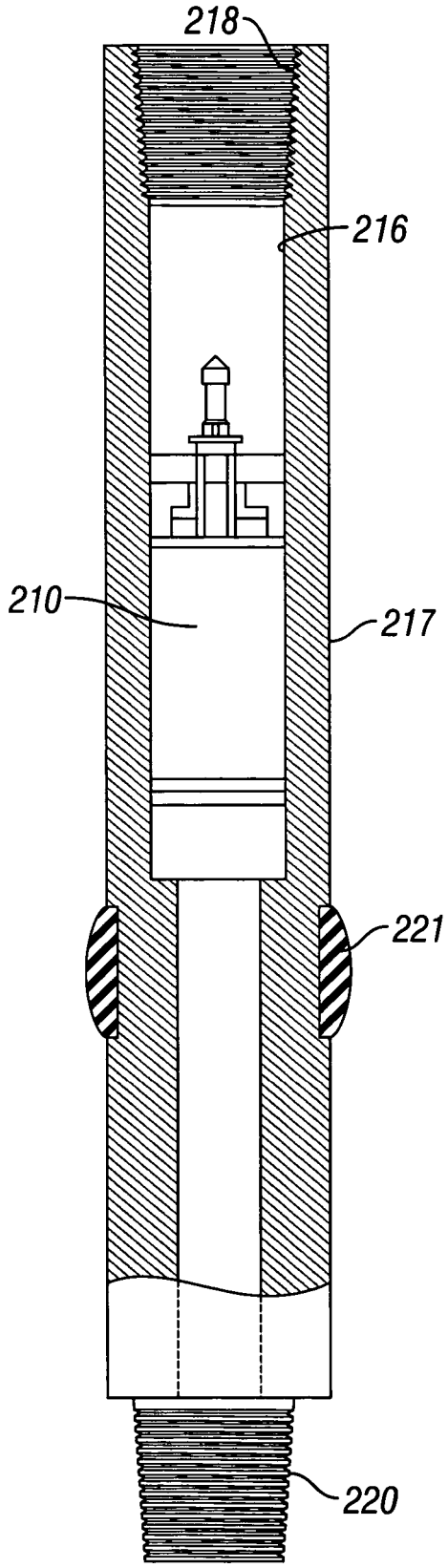
FIG. 9 is a side elevation view of the device of the preferred embodiment of the present invention inserted in a radially enlarged portion of a kelly saver sub.

Referring now to FIG. 9, the assembled valve of the preferred embodiment of the invention, designated generally by the numeral 210, is illustrated in FIG. 9 disposed within a radially enlarged portion 216 of a kelly saver sub 217. Kelly saver sub 217 has a box 218 at the upper end thereof to accommodate the pin of the kelly (not shown) and a pin 220 at the lower end thereof for insertion into either the drill pipe or a lower kelly safety valve (neither shown). The kelly saver sub 217 also includes an optional rubber bumper 221 or a bronze wear pad which serves to space the kelly from the surface casing and thereby prevents wear to both.

In the operation of the mudsaver valve illustrated in FIGS. 1–9, the drilling fluid being pumped down from the earth's surface will enter the box end 218 illustrated in FIG. 9 and come into contact with the top of the mudsaver valve in accordance with the invention and flow down through the mud saver valve by virtue of the fact that the piston has been pushed down by the pressure being pumped from the earth's surface, thus overcoming the spring illustrated in FIG. 6. The mud being pumped down goes first through the orifice 60 and then into the chambers 48 and 46. However, because the diverter stem valve 150 is forced against the surface 78 of the diverter valve 72, the mud is then pumped around the exterior of the spear 40 and against the surface 98 of the piston 90, and will overcome the spring pressure of spring 110 to allow mud to be pumped through the interior of the piston 90, and out through the pin end 220 illustrated in FIG. 9.

Whenever the mud pumps are cut off at the earth's surface, indicating that the pipe joints can be broken out, the spring pressure from the spring illustrated in FIG. 6 then pushes the enlarged end 98 of the piston 90 up against the lower end of the cap 130. Thus, when the pipe joints are broken out, the mud is prevented from passing out the lower end of the cylinder 10 because of a metal-to-metal seal between the cap lower surface and the upper surface on the piston. The lower surface of the cap and the upper surface of the piston use tungsten carbide inserts, and/or are coated with tungsten carbide to prevent excessive wear to either part.

Despite the mud saver valve according to the present invention being essentially shut in when the mud pumps are turned off, the downhole pressure of the fluids can be measured by the fact that the diverter valve stem 150 is moved off of its engagement with the face 78 of the diverter valve because of the spring 110 and hence mud can then flow through the diverter valve up to and through the chambers 46 and 48 and then out through the orifice 60 to travel back up to the earth's surface where the pressure and other parameters related to the downhole fluids can be measured.

The invention claimed is:

1. A sub-assembly for use in a mud saver valve, comprising:

a spear having first and second ends, said spear having first and second fluid chambers, the first said chamber having a given internal diameter and the second said chamber having sidewalls around said second chamber and having an internal diameter less than said given internal diameter, the said first end of said spear having internal threads and being open for receiving fluids into said first chamber and the second end of said spear being shaped and sized to accommodate a wireline overshot to remove the spear from a mud saver valve assembly, said first fluid chamber being in fluid communication with said second fluid chamber, and having a first truncated, inverted cone valve seat between said first and second fluid chambers, said first and second fluid chambers being in fluid communication with the annulus surrounding said spear through at least one portal through the said sidewalls of the said second chamber of said spear, said second chamber further having a cone shaped end distal from said first truncated, inverted cone valve seat;

a fluid diverter valve having a generally cylindrical body, and having first and second ends, and a fluid passageway between the first and second ends of said fluid diverter valve, the first end of said diverter valve having a given external diameter and a second truncated, inverted cone valve seat for receiving a second cone valve, and the second end of said diverter valve having an external diameter greater than the given external diameter of the first end of said diverter valve, said diverter valve having external threads between said first and second ends of said diverter valve; and a diverter valve stem having back-to-back, first and second cone valves, said second cone valve being angled to seat against the said second seat of said fluid diverter valve to substantially prevent a fluid flow in a first direction, said first cone valve having an apex, and having a linear extension from its apex, said linear extension having a cone shaped end distal to said apex of said first cone valve and a given length for allowing said first cone valve to move in close proximity to said first truncated, inverted cone valve seat, in response to a fluid flow in a second direction, and for preventing said first cone valve from seating against the first seat in said spear, wherein the prevention of seating between the first cone valve and the first seat is, at least in part, due to the cone shaped end of said linear extension contacting the cone shaped end of said second chamber, and wherein said moving of first cone valve within close proximity to said first truncated, inverted cone valve seat allows the pressure and other parameters of at least one downhole fluid to be measured, and wherein said diverter valve stem is located within the first fluid chamber of said spear and said diverter valve is threaded into the interior of said spear.

2. A sub-assembly for use in a mud saver valve, comprising:

a spear having first and second ends, said spear having first and second fluid chambers, the first said chamber having a given internal diameter and the second said chamber having sidewalls around said second chamber and having an internal diameter less than said given internal diameter, the said first end of said spear having internal threads and being open for receiving fluids into said first chamber and the second end of said spear being shaped and sized to accommodate a wireline overshot to remove the spear from a mud saver valve assembly, said first fluid chamber being in fluid communication with said second fluid chamber, and having a first valve seat between said first and second fluid chambers, said first and second fluid chambers being in fluid communication with the annulus surrounding said spear through at least one portal through the said sidewalls of the said second chamber of said spear, said second chamber further having a cone shaped end distal from said first truncated, inverted cone valve seat;

a fluid diverter valve having a generally cylindrical body, and having first and second ends, and a fluid passageway between the first and second ends of said fluid diverter valve, the first end of said diverter valve having a given external diameter and a second seat for receiving a second cone valve, and the second end of said diverter valve having an external diameter greater than the given external diameter of the first end of said diverter valve, said diverter valve having external threads between said first and second ends of said diverter valve;

a diverter valve stem having back-to-back, first and second cone valves, said second cone valve being angled to seat against the said second seat of said fluid diverter valve to substantially prevent a fluid flow in a first direction, said first cone valve having an apex, and having a linear extension from its apex, said linear extension having a cone shaped end distal to said apex of said first cone valve and a given length for allowing said first cone valve to move in close proximity to said first truncated, inverted cone valve seat, in response to a fluid flow in a second direction, and for preventing said first cone valve from seating against the first seat in said spear, wherein the prevention of seating between the first cone valve and the first seat is, at least in part, due to the cone shaped end of said linear extension contacting the cone shaped end of said second chamber, and wherein said moving of first cone valve within close proximity to said first truncated, inverted cone valve seat allows the pressure and other parameters of at least one downhole fluid to be measured, and wherein said diverter valve stem is located within the first fluid chamber of said spear and said diverter valve is threaded into the interior of said spear; and a cylinder having first and second ends, the first end of said cylinder having a removable cap and the second end of said cylinder having internal threads, wherein said end cap is connected to said cylinder and to said spear by at least one shear pin.

3. A mud saver valve, comprising:

a spear having first and second ends, said spear having first and second fluid chambers, the first said chamber having a given internal diameter and the second said chamber having sidewalls around said second chamber and having an internal diameter less than said given internal diameter, the said first end of said spear having internal threads and being open for receiving fluids into said first chamber and the second end of said spear being shaped and sized to accommodate a wireline overshot to remove the spear from a mud saver valve assembly, said first fluid chamber being in fluid communication with said second fluid chamber, and having a first valve seat between said first and second fluid chambers, said first and second fluid chambers being in fluid communication with the annulus surrounding said spear through at least one portal through the said sidewalls of the said second chamber of said spear, said second chamber further having a cone shaped end distal from said first truncated, inverted cone valve seat;

a fluid diverter valve having a generally cylindrical body, and having first and second ends, and a fluid passageway between the first and second ends of said fluid diverter valve, the first end of said diverter valve having a given external diameter and a second seat for receiving a second cone valve, and the second end of said diverter valve having an external diameter greater than the given external diameter of the first end of said diverter valve, said diverter valve having external threads between said first and second ends of said diverter valve;

a diverter valve stem having back-to-back, first and second cone valves, said second cone valve being angled to seat against the said second seat of said fluid diverter valve to substantially prevent a fluid flow in a first direction, said first cone valve having an apex, and having a linear extension from its apex, said linear extension having a cone shaped end distal to said apex of said first cone valve and a given length for allowing said first cone valve to move in close proximity to said first truncated, inverted cone valve seat, in response to a fluid flow in a second direction, and for preventing said first cone valve from seating against the first seat in said spear, wherein the prevention of seating between the first cone valve and the first seat is, at least in part, due to the cone shaped end of said linear extension contacting the cone shaped end of said second chamber, and wherein said moving of first cone valve within close proximity to said first truncated, inverted cone valve seat allows the pressure and other parameters of at least one downhole fluid to be measured, and wherein said diverter valve stem is located within the first fluid chamber of said spear and said diverter valve is threaded into the interior of said spear;

a cylinder having first and second ends, the first end of said cylinder having a removable cap and the second end of said cylinder having internal threads, wherein said end cap is connected to said cylinder and to said spear by at least one shear pin;

a piston having a fluid passageway along its entire length, and having first and second ends, said first end of said piston having a first external diameter, and said second end of said piston having a second external diameter greater than said first external diameter, and a spring having first and second ends and sized to slide over the first end of said piston, but not over the second end of said piston, wherein said piston is moved into the interior of said cylinder, large end first; and an adjustment ring having external threads selected to be threaded into the second end of said cylinder and to bear against the first end of said spring, wherein said adjustment ring is threaded into the second end of said cylinder against one end of said spring, and wherein said adjustment ring will vary a tension force exerted by said spring on said piston as desired, whereby the variation of the spring tension force compensates for changes in weights of drilling mud.

* * * * *